US011286612B2

(12) United States Patent
Song

(10) Patent No.: US 11,286,612 B2
(45) Date of Patent: Mar. 29, 2022

(54) IRON WITH HEAT CONTROL DISPLAY ON HANDLE

(71) Applicant: Hamilton Beach Brands, Inc., Glen Allen, VA (US)

(72) Inventor: Brandon Sung-Hwan Song, Glen Allen, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 88 days.

(21) Appl. No.: 16/561,225

(22) Filed: Sep. 5, 2019

(65) Prior Publication Data

US 2021/0071348 A1 Mar. 11, 2021

(51) Int. Cl.
*D06F 75/26* (2006.01)

(52) U.S. Cl.
CPC ..... *D06F 75/265* (2013.01); *D06F 75/26* (2013.01)

(58) Field of Classification Search
CPC ..... D06F 75/00–36; D06F 71/00–34
See application file for complete search history.

(56) References Cited

U.S. PATENT DOCUMENTS 2,266,708 A * 12/1941 Jepson ..... H05B 1/0213 219/252
2,288,175 A * 6/1942 Almquist ..... D06F 75/265 337/375
2,853,814 A * 9/1958 Brandler ..... D06F 75/18 38/77.83
2,976,627 A * 3/1961 Kistner ..... D06F 75/265 38/77.7
3,038,269 A * 6/1962 Knapp ..... D06F 75/18 38/77.5
3,224,122 A * 12/1965 Jepson ..... D06F 75/18 38/77.2
4,686,352 A * 8/1987 Nawrot ..... D06F 75/26 200/61.52
4,733,035 A * 3/1988 Ohashi ..... H01H 13/62 200/43.18
D340,329 S 10/1993 Barrault
5,349,767 A * 9/1994 Foo ..... D06F 71/026 38/16
D386,863 S 11/1997 Lin
5,901,481 A * 5/1999 Simmons ..... D06F 75/38 38/93
6,029,379 A * 2/2000 Brandolini ..... D06F 75/265 38/77.7
D516,765 S 3/2006 Lee
7,034,236 B2 * 4/2006 Endres ..... H01H 19/635 200/17 R (Continued)

FOREIGN PATENT DOCUMENTS

EP 459559 A * 11/1991

*Primary Examiner* — Ismael Izaguirre
(74) *Attorney, Agent, or Firm* — Alexander D. Raring

(57) ABSTRACT

An iron includes: a housing; a handle attached to an upper portion of the housing; a sole plate attached to a lower portion of the housing; a heating element positioned within the housing to heat the sole plate; a controller operatively connected with the heating element to regulate heat produced by the heating element; and a display mounted on one of the housing and the handle, the display operatively connected with the controller, the display configured such that manipulation of the display selects a heat level associated with the sole plate.

20 Claims, 15 Drawing Sheets

(56) References Cited

U.S. PATENT DOCUMENTS

| | | | | |
|---|---|---|---|---|
| 7,062,869 | B1 * | 6/2006 | Pilcher | D06F 75/22 38/77.5 |
| D519,699 | S | 8/2006 | Lee | |
| D546,518 | S | 7/2007 | Massip et al. | |
| D548,914 | S | 8/2007 | Muller | |
| D560,322 | S | 1/2008 | Massip et al. | |
| D560,323 | S | 1/2008 | Massip et al. | |
| D568,020 | S | 4/2008 | Poon | |
| D599,071 | S | 8/2009 | Massip et al. | |
| D610,764 | S | 2/2010 | Massip et al. | |
| D610,765 | S | 2/2010 | Massip et al. | |
| D621,116 | S | 8/2010 | Massip et al. | |
| D624,266 | S | 9/2010 | Massip et al. | |
| 2006/0081588 | A1 * | 4/2006 | Bowser | D06F 75/265 219/248 |

* cited by examiner

IRON WITH HEAT CONTROL DISPLAY ON HANDLE

FIELD OF THE DISCLOSURE

The present disclosure relates generally to an iron, and more particularly to a combined iron and steamer appliance.

BACKGROUND

Clothes irons (also termed clothing irons, flatirons, or simply irons) are appliances used for applying heat and pressure to smooth wrinkles in clothing and other fabrics. Clothes irons comprise a heating element that heats up a metallic soleplate such that the hot soleplate may be pressed against fabric to smooth wrinkles.

Steam irons are a subset of clothes irons. Steam irons enable steam to be produced and applied to clothing in order to increase an iron's ability to smooth wrinkles and/or to enable wrinkles to be smoothed in certain fabrics that may be more difficult to smooth, such as cotton. Steam irons further comprise a water tank and typically a valve to selectively release water from the water tank onto an interior surface of the hot soleplate. The hot soleplate vaporizes the water and the resulting steam is released through holes in the soleplate.

Irons often include controls that regulate the heat level in the soleplate. Such controls can lead the user to correctly select an appropriate heat level for various textiles, such as cotton, wool or synthetics. One common control configuration is a dial mounted on the housing of iron below the handle. Rotation of the dial selects the desired heat level.

User interface is of high importance to consumers. It may be desirable to provide iron designs in which novel heat level controls are configured differently and/or more conveniently for the user.

SUMMARY

As a first aspect, embodiments of the invention are directed to an iron. The iron comprises: a housing; a handle attached to an upper portion of the housing; a sole plate attached to a lower portion of the housing; a heating element positioned within the housing to heat the sole plate; a controller operatively connected with the heating element to regulate heat produced by the heating element; and a display mounted on one of the housing and the handle, the display operatively connected with the controller, the display configured such that manipulation of the display selects a heat level associated with the sole plate. The display is moveable when manipulated.

As a second aspect, embodiments of the invention are directed to an iron comprising: a housing; a handle attached to an upper portion of the housing; a sole plate attached to a lower portion of the housing; a heating element positioned within the housing to heat the sole plate; a controller operatively connected with the heating element to regulate heat produced by the heating element; and a heat control unit operatively connected with the controller. The heat control unit includes a display, the heat control unit configured as a toggle mechanism with a moveable member, wherein the toggle mechanism is configured such that actuation of the moveable member sequentially selects different heat levels for the sole plate.

As a third aspect, embodiments of the invention are directed to an iron comprising: a housing; a handle attached to an upper portion of the housing; a sole plate attached to a lower portion of the housing; a heating element positioned within the housing to heat the sole plate; a controller operatively connected with the heating element to regulate heat produced by the heating element; and a heat control unit attached to the handle and operatively connected with the controller.

DETAILED DESCRIPTION

Figure 1:
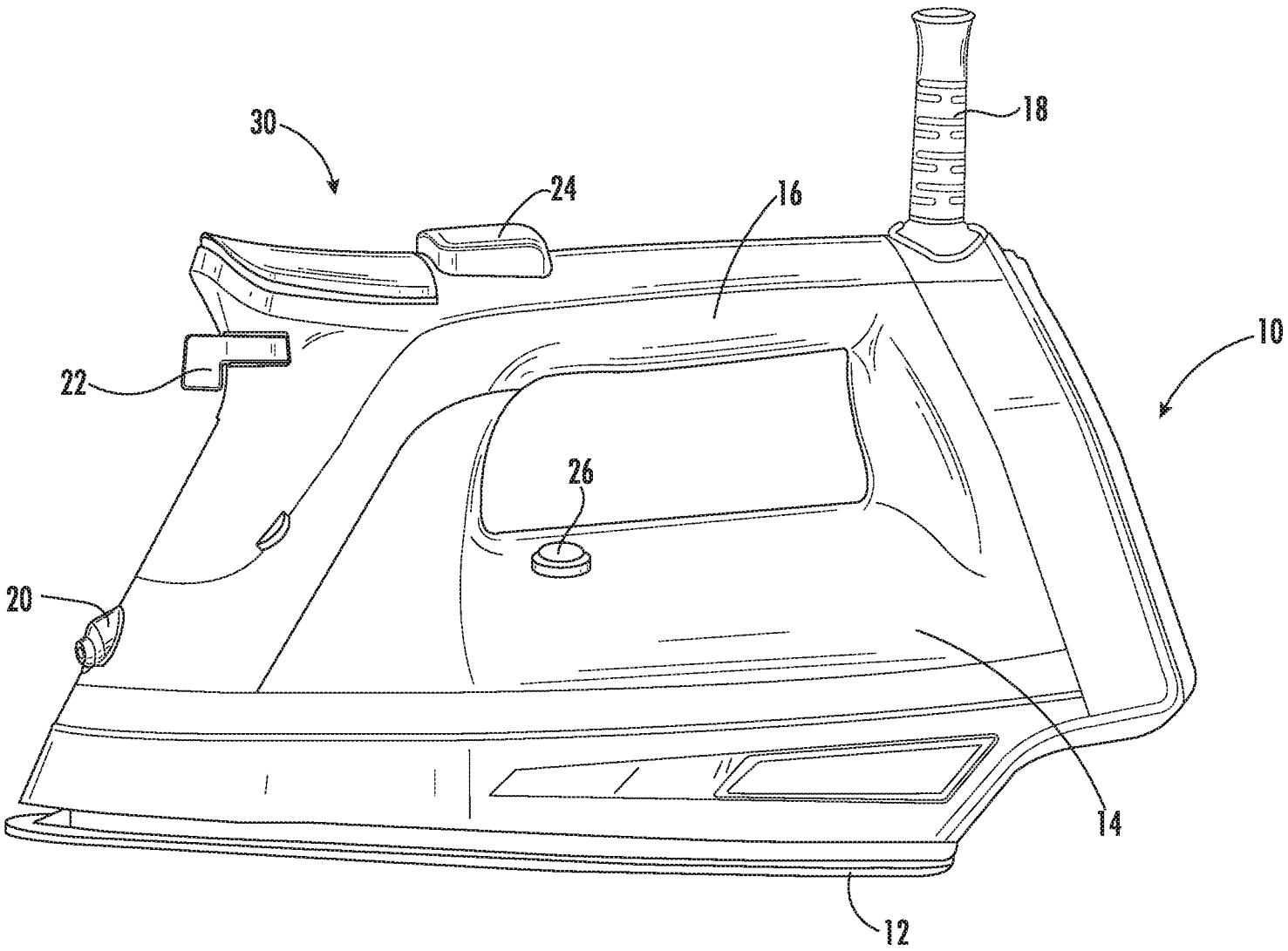
FIG. 1 is a side perspective view of a steam iron according to embodiments of the invention.

The present disclosure now is described more fully hereinafter with reference to the accompanying drawings, in which some embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Referring now to the drawings, a steam iron, designated broadly at 10, is illustrated in FIGS. 1-11. The iron 10 is in many ways conventional, with a sole plate 12 underlying a housing 14 in which the operational components of the iron 10 are contained. A handle 16 forms the upper portion of the housing 14. A power cord 18 is mounted to a rear section of the housing 14 and extends upwardly therefrom. Other controls, such as a spray nozzle 20, a steam activation lever 22, steam control buttons 24*a*, 24*b*, and a self-clean button 26 are mounted at various points on the housing 14, and are operatively connected with a water reservoir (not shown). These components/features may be of conventional structure and operation and need not be described in detail herein.

Figure 2:
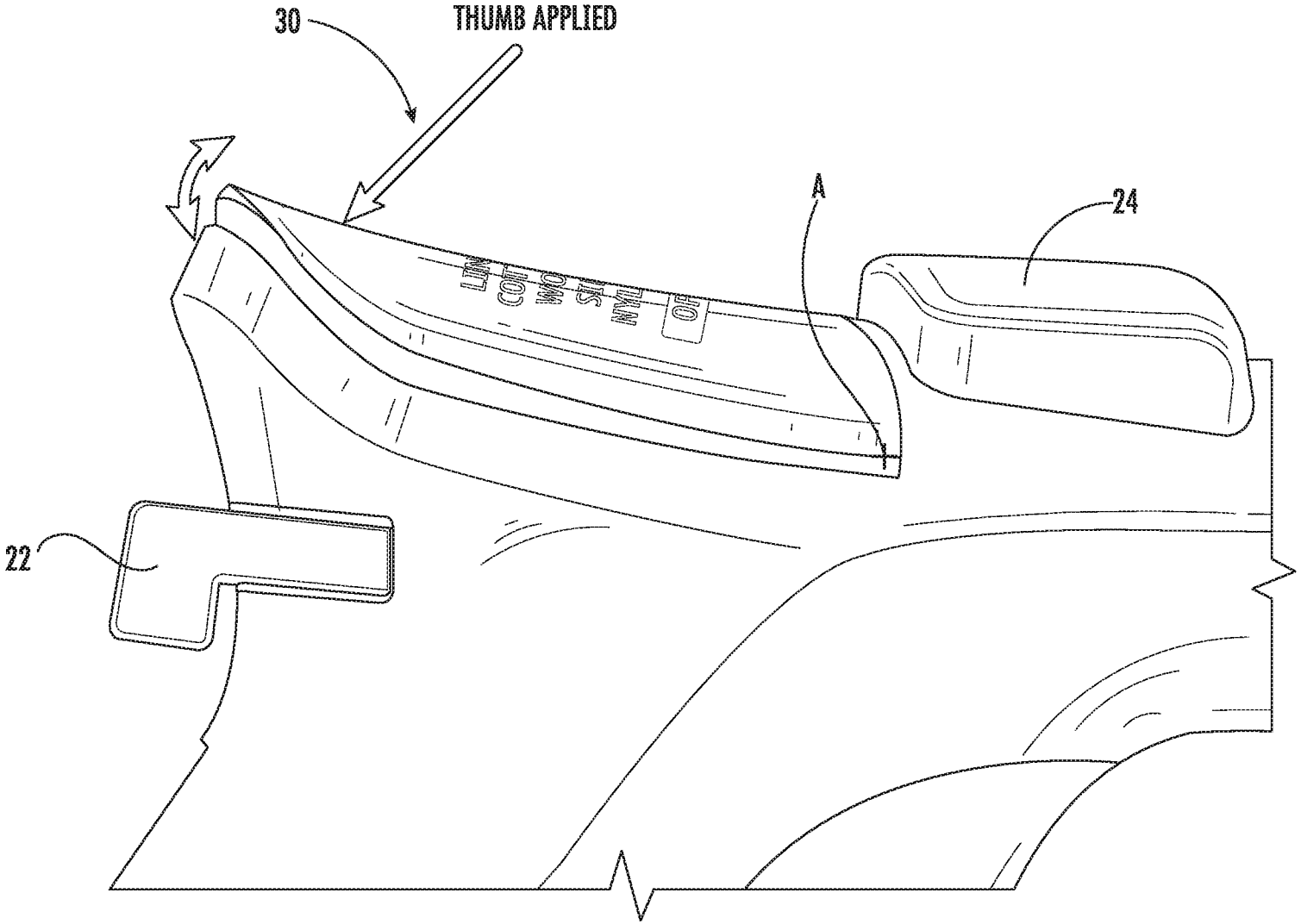
FIG. 2 is an enlarged partial side perspective view of the iron of FIG. 1 illustrating how the display moveably pivots to change heat settings.

A heat control unit 30 is mounted to the front portion of the handle 16 (see FIG. 2). The heat control unit 30 includes a display cover 32 (FIGS. 10 and 11), a light pipe frame 34 (FIGS. 7 and 8), a floor 33 (FIG. 5), light pipes 37 (FIGS. 8 and 12), and a PCB 39 (FIG. 9), all of which are mounted to a main body 36 (FIGS. 3 and 4) of the handle 16. These components are described in greater detail below.

Figure 3:
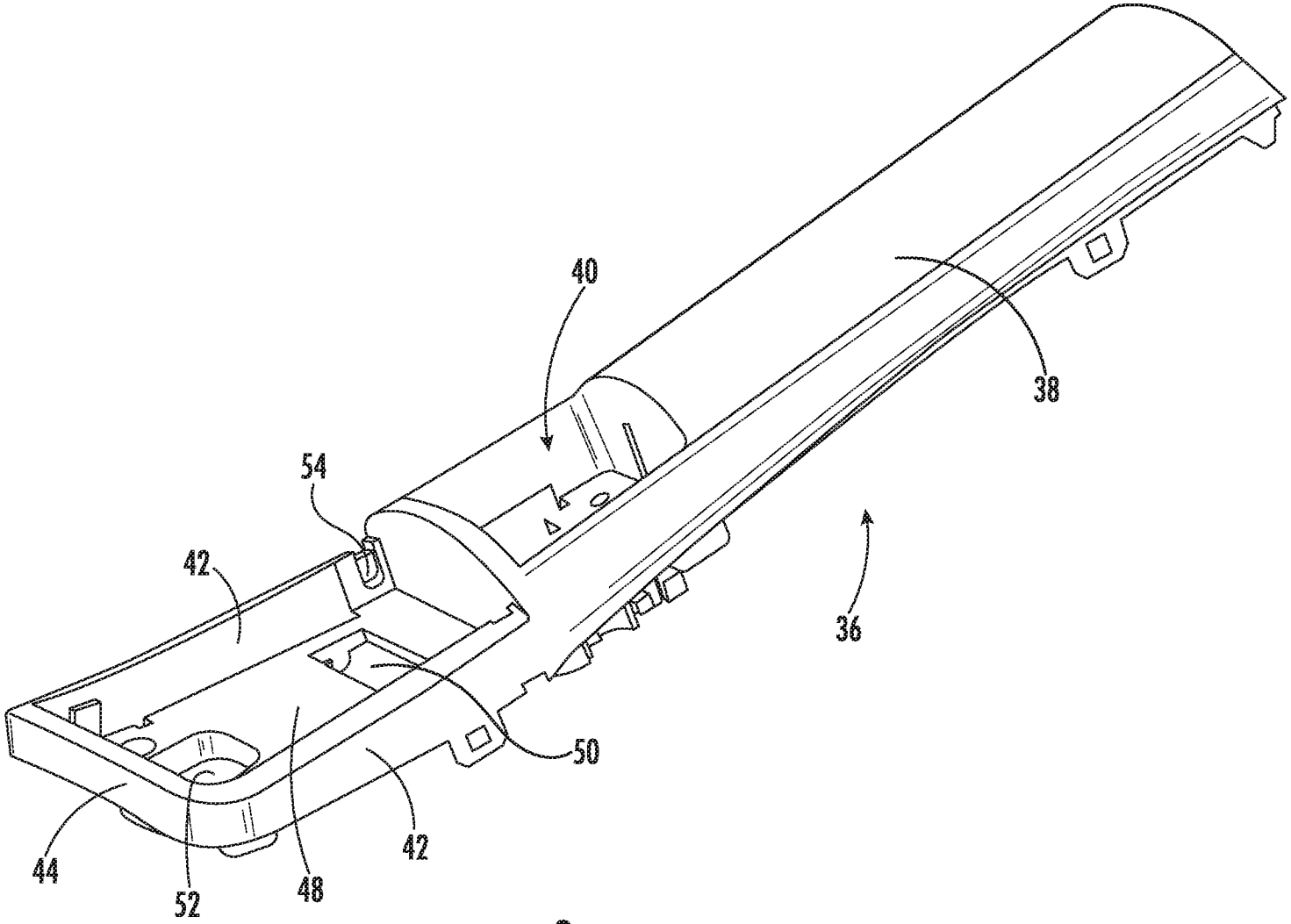
FIG. 3 is a front perspective view of the main body of the heat control unit of the iron of FIG. 1.
Figure 4:
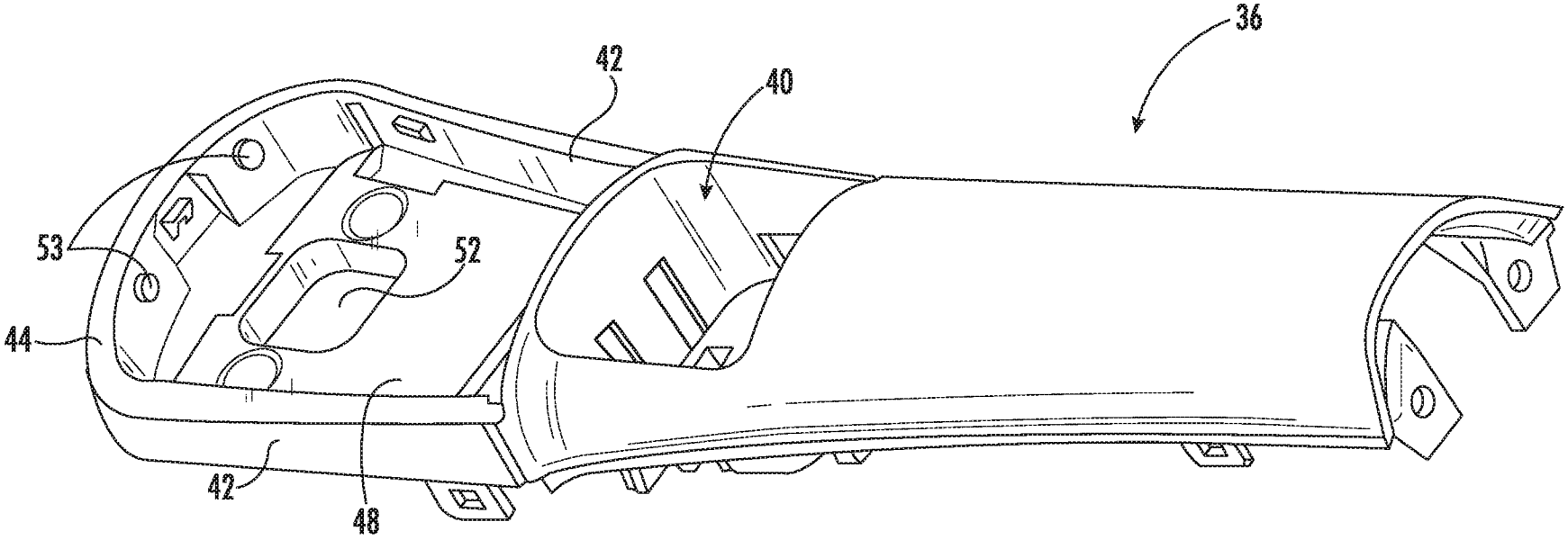
FIG. 4 is a rear perspective view of the main body of FIG. 3.

As shown in FIGS. 3 and 4, the main body 36 includes a rear portion 38 that forms much of the handle 16. A well 40 resides in front of the rear portion 38 and provides a receptacle for the steam control buttons 24*a*, 24*b*. Side walls 42 extend forwardly from the well 40, and a front wall 44 spans the front ends of the side walls 42. A floor 48 extends between the side walls 42 and includes a rear aperture 50 and a front aperture 52. A round indentation 54 is present on the inner surface of each side wall near the well 40. A hollow plug 55 (see FIGS. 8 and 12) is inserted into the front aperture 52. Two short posts 53 extend rearwardly from the rear surface of the front wall 44.

Figure 5:
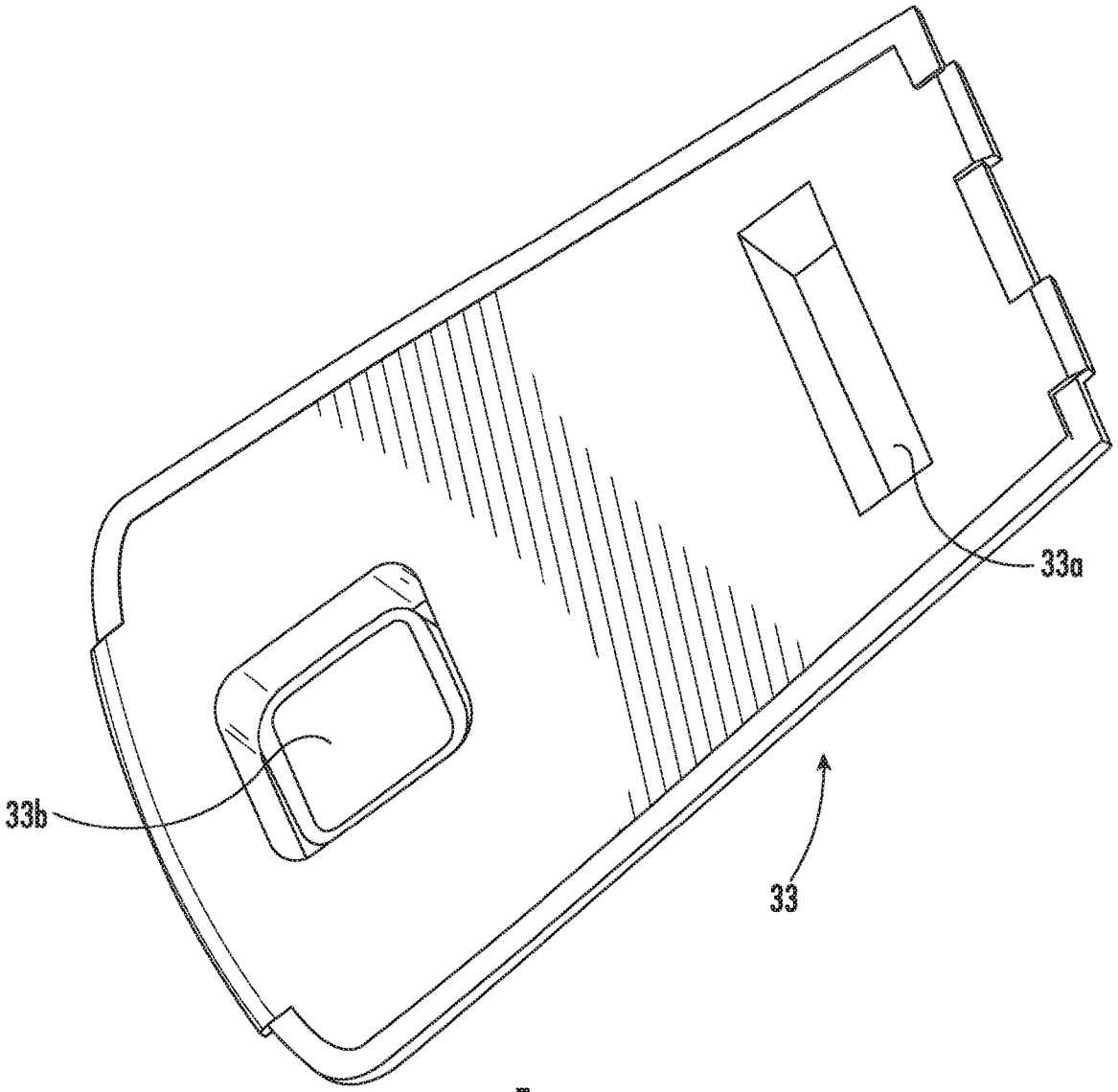
FIG. 5 is a rear perspective view of the floor of the heat control unit of the iron of FIG. 1.
Figure 6:
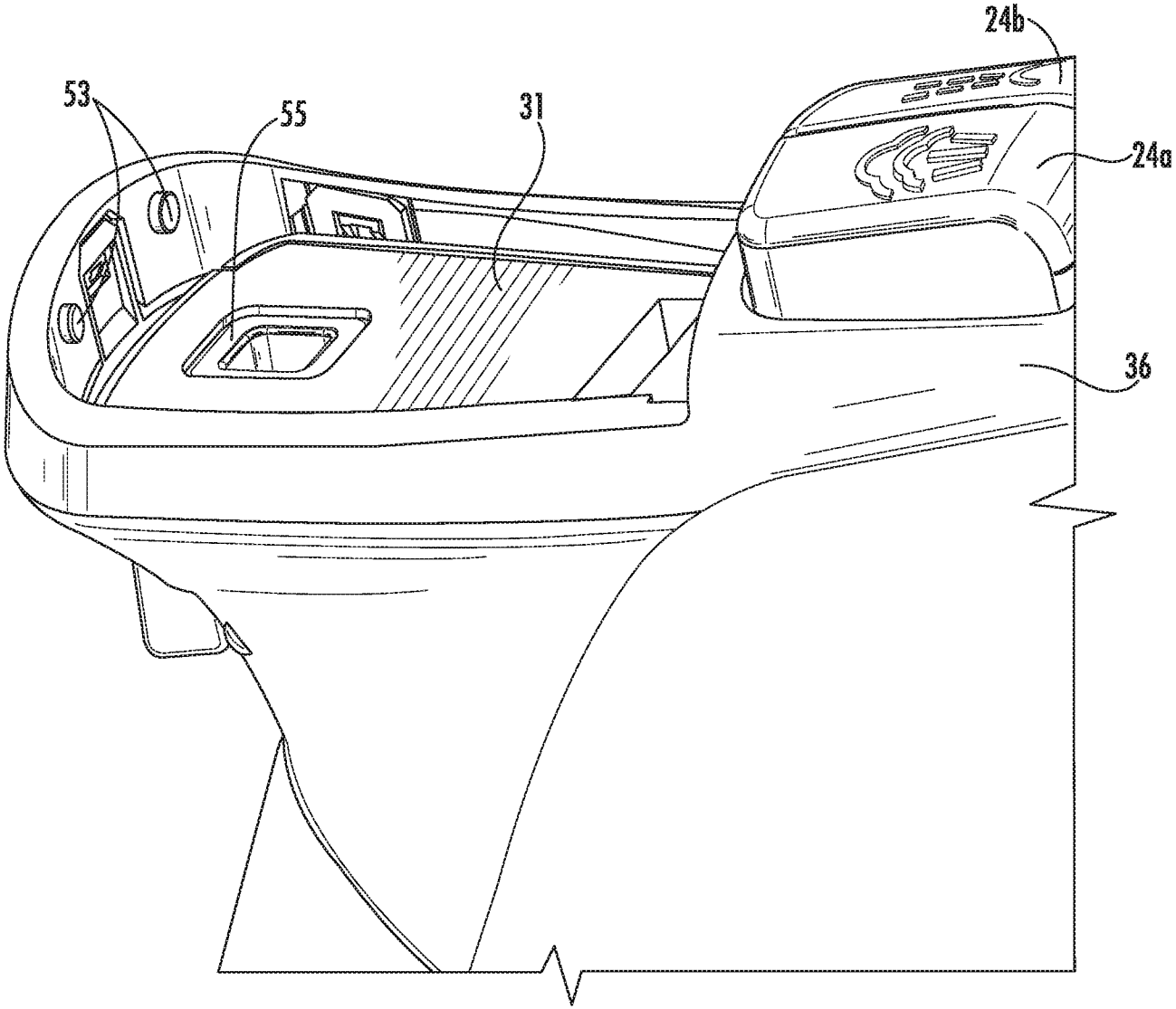
FIG. 6 is a top perspective view of the floor of FIG. 5 and the main body of FIG. 3 in an assembled condition.
Figure 7:
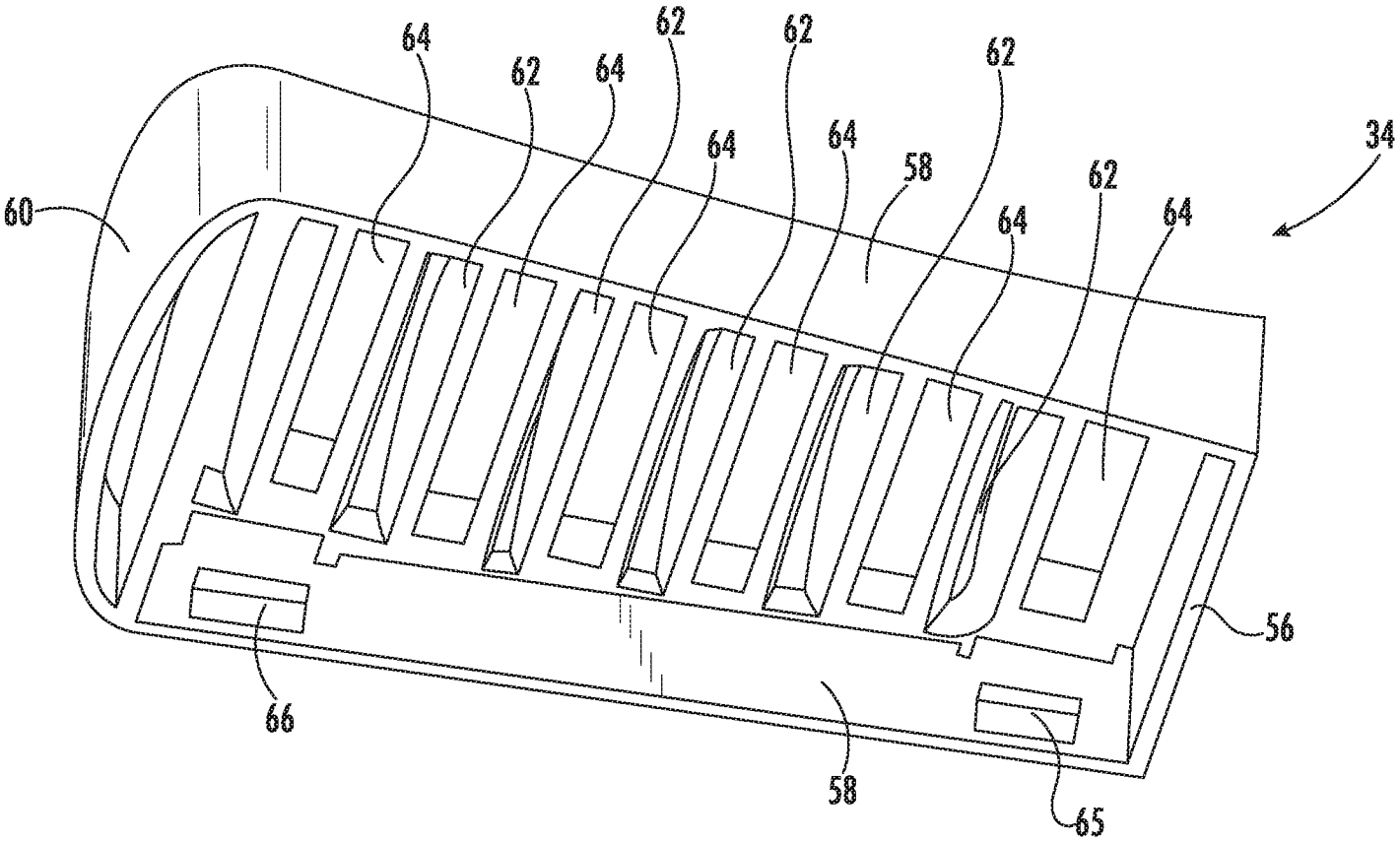
FIG. 7 is a bottom perspective view of the light pipe frame of the heat control unit of the iron of FIG. 1.
Figure 8:
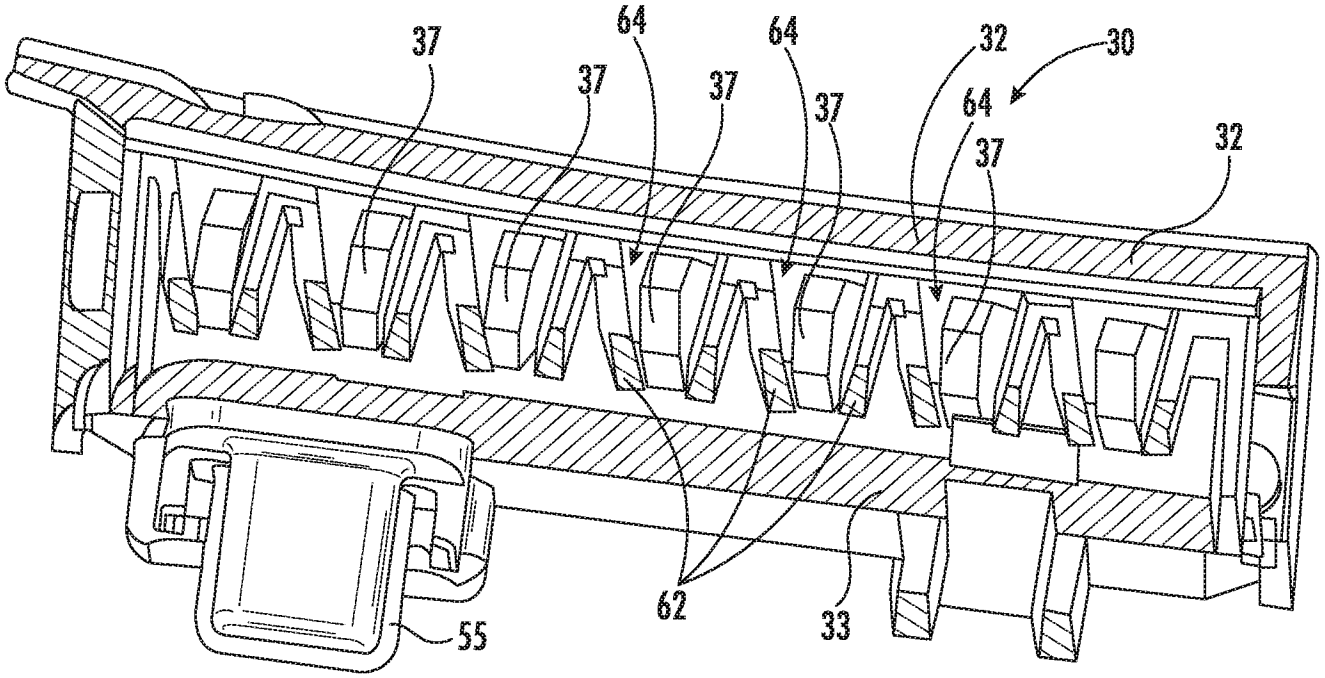
FIG. 8 is a side section view of the light pipe frame, display cover, floor and plug of the heat control unit of the iron of FIG. 1.

Referring now to FIG. 5, the floor 33 is generally a flat panel that includes an aperture 33*a* that aligns with the rear aperture 50 of the main body 36, and also includes an opening 33*b* that aligns with the front aperture 52 of the main body 36. The floor 33 overlies the floor 48 of the main body 36 and underlies the PCB 39 (see FIG. 12).

The light pipe frame 34 (FIGS. 7 and 8) has a rear wall 56, side walls 58 and an arcuate front wall 60. Inverted V-shaped dividers 62 span the side walls 58 and divide the space within the light pipe frame 34 into six compartments 64. Projections 65 extend inwardly from the lower portions of the side walls to provide support for the PCB 39. The light pipes 37 fit within the compartments 64, and are mounted on the PCB 39.

Figure 9:
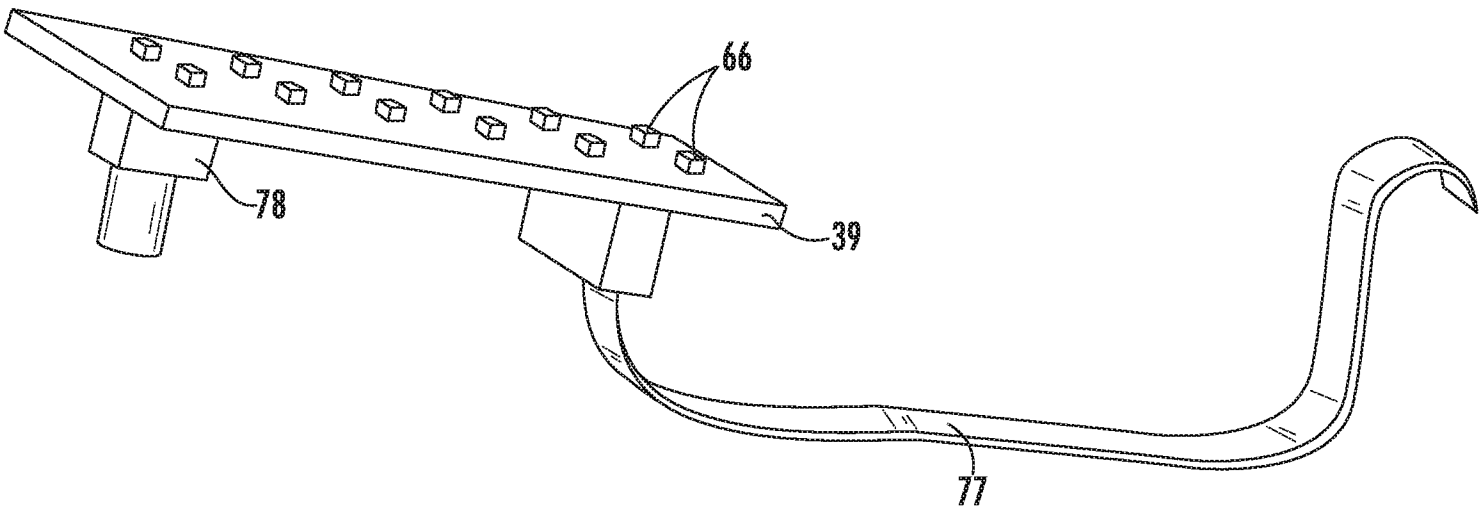
FIG. 9 is a rear perspective view of the PCB, wiring and tactile switch of the heat control unit of the iron of FIG. 1.
Figure 12:
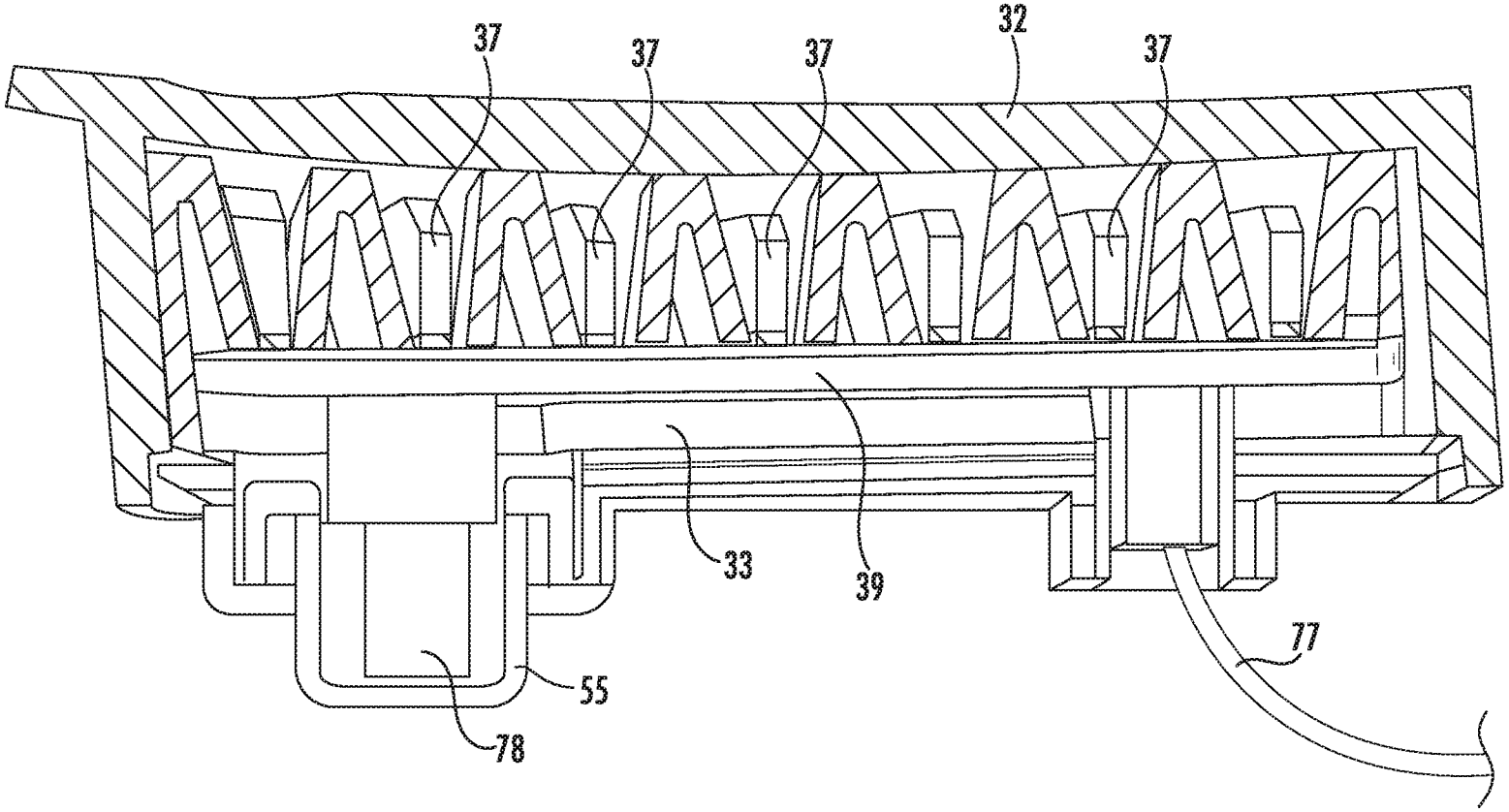
FIG. 12 is a side section view of the heat control unit of the iron of FIG. 1.

The PCB 39 (FIG. 9) overlies the floor 33 (this is shown in FIG. 12). As shown in FIG. 9, the PCB 39 includes LEDs 66 on its upper surface, each of which is configured to illuminate a respective one of the light pipes 37. A tactile switch 78 is mounted to the lower surface of the PCB 39 and extends through the apertures 33*b* and 52 in the floor 33 and the main body 36. The lower end of the tactile switch 78 resides just above the lower surface of the plug 55 in the main body 36. Wiring 77 is attached to the rear section of the PCB 39 and is routed therefrom through the apertures 33*a* and 50 in the floor 33 and main body 36 to a controller 90 (which can be housed anywhere in the iron 10, but is typically in a rear portion of the handle 16).

Figure 13:
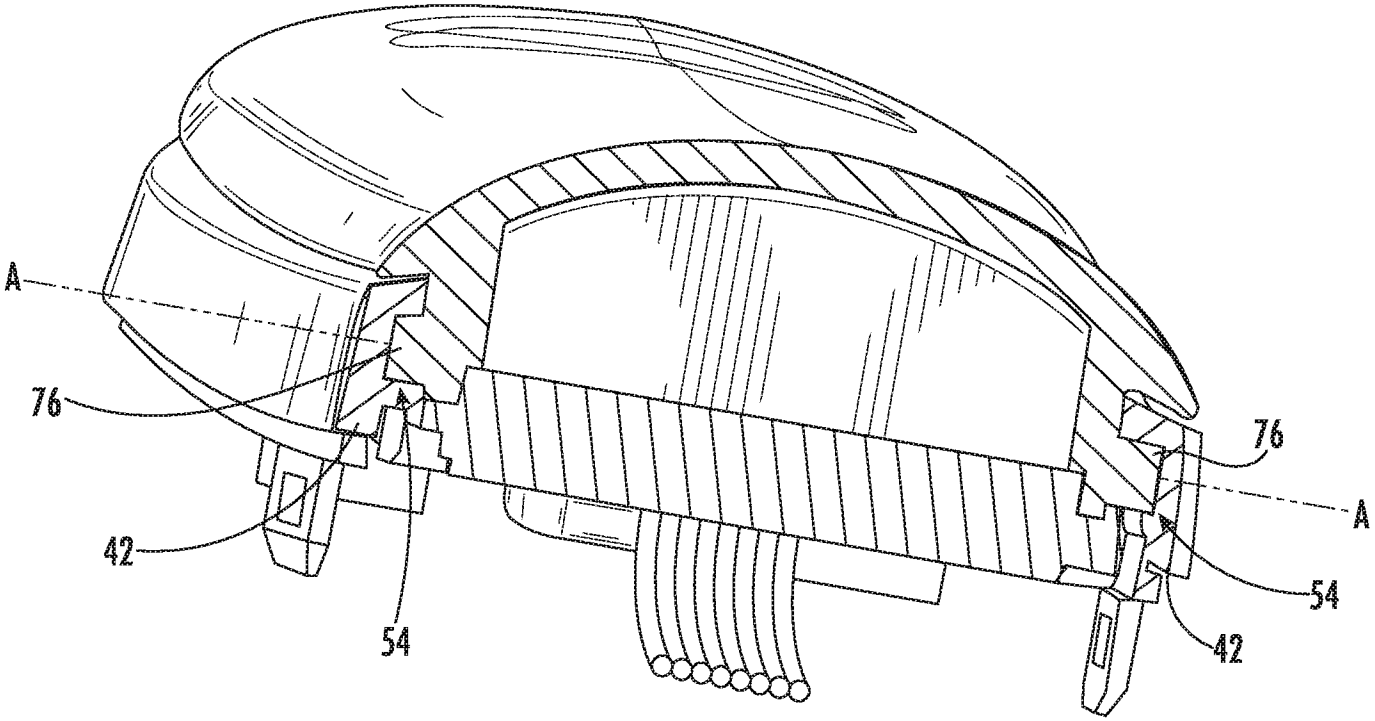
FIG. 13 is a rear perspective section view of the heat control unit of the iron of FIG. 1.

The display cover 32 (FIGS. 10 and 11), includes a rear wall 70, side walls 72 and an arcuate front wall 74. Round posts 76 extend outwardly from the outer surfaces of the side walls 72. As can be seen in FIG. 13, the posts 76 are inserted into the indentations 54 in the main body 36, thus forming a pivot axis A between the display cover 32 and the main body 36. Also, two oblong recesses 79 are present in the front surface of the front wall 74 (FIG. 11). The recesses 79 receive the posts 53 on the front wall 44 of the main body 36. Thus, the front end of the display cover 32 is moveable, i.e. has the capability of moving vertically relative to the main body 36 (within the confines established by the recesses 79) as the display cover 32 about the pivot axis A established by the posts 76. A thumb pad 81 is recessed into the upper surface of the display cover 32.

Figure 10:
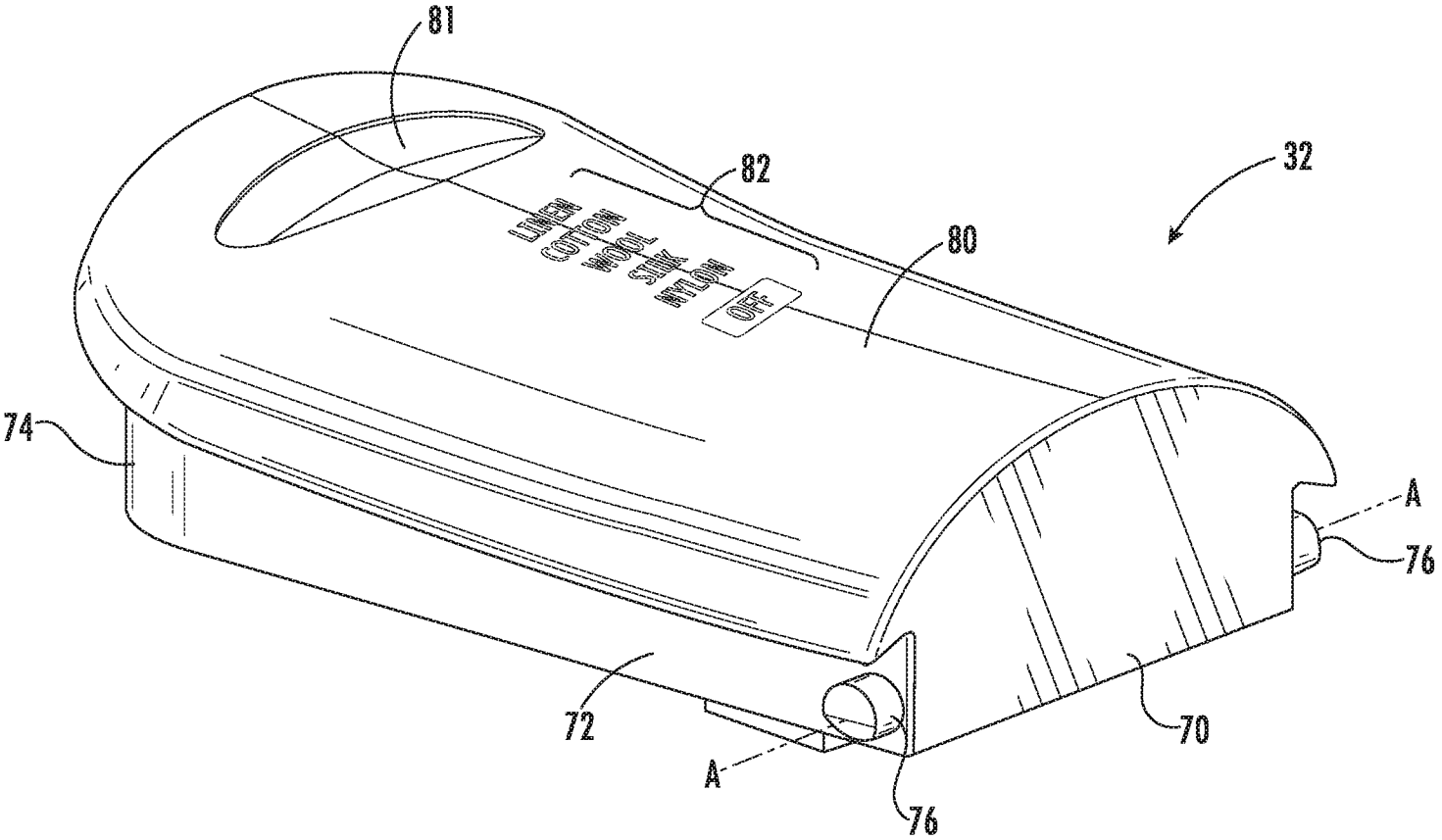
FIG. 10 is a rear top perspective view of the display cover of the heat control unit of the iron of FIG. 1.
Figure 11:
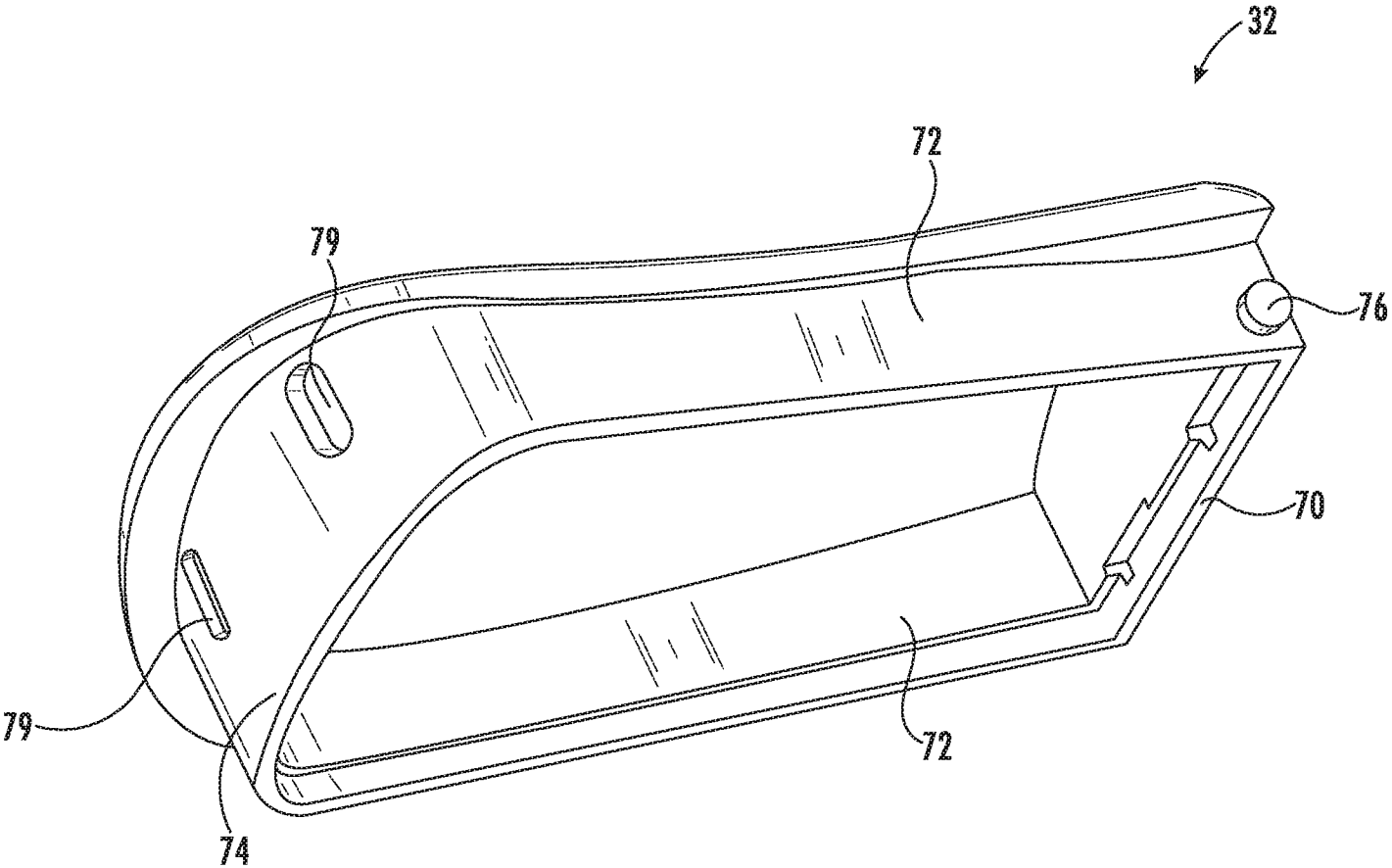
FIG. 11 is a front bottom perspective view of the display cover of FIG. 10.
Figure 14:
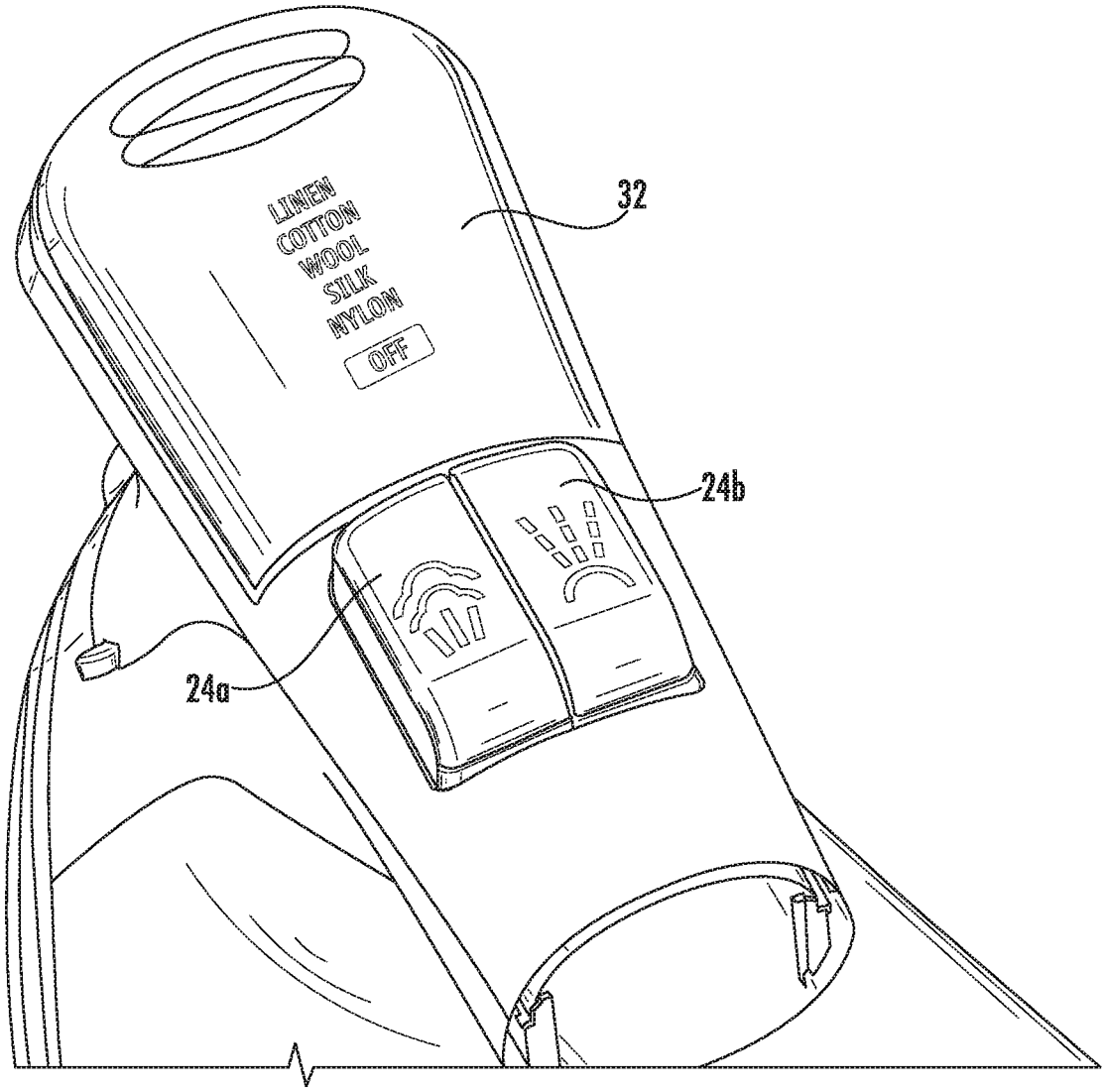
FIG. 14 is a rear top perspective view of the heat control unit of the iron of FIG. 1

Referring now to FIGS. 10 and 14, the upper surface 80 of the display cover 32 includes indicia 82 that lists the operational heat levels of the iron 10 (e.g., "linen," "cotton," "wool," "silk," nylon," and "off"). In this embodiment, each of the heat levels of the indicia 82 is aligned with one of the light pipes 39. The display cover 32 is typically transparent or translucent, such that illumination (e.g., from one of the light pipes 37) originating below the display cover 32 shines through the upper surface 80.

Figure 15:
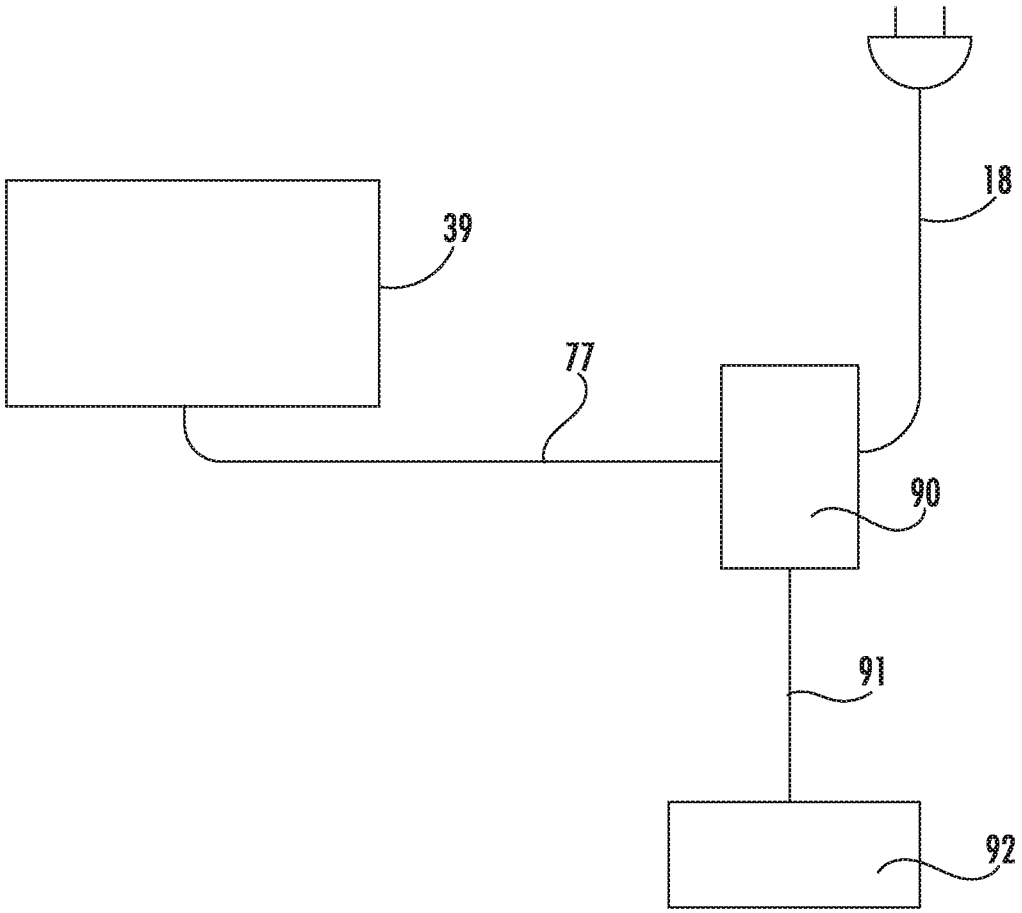
FIG. 15 is a schematic diagram illustrating the electrical layout of the iron of FIG. 1.

As shown schematically in FIG. 15, the controller 90 is attached to the power cord 18. An electrical line 91 connects the controller 90 to a heating element 92 that is positioned above the sole plate 12 to provide heat thereto. The wiring 77 is attached between the PCB 39 and the controller 12. In some embodiments, other of the features of the iron 10 (such as the steam activation lever 22, the steam level buttons 24*a*, 24*b*, and the spray nozzle 20) may also be attached to the controller 90.

In operation, the power cord 18 is connected to a power source (e.g., an electrical outlet). The controller 90 is configured such that, at this point, the heating element receives no current. The user can select a heat setting by grasping the handle 16 and depressing the front end of the display cover 32 (typically the user does so with a thumb on the thumb pad 81). Depressing the front end of the display cover 32 causes it to descend slightly as it pivots about the pivot axis A. As the front end lowers, the tactile switch 74 lowers also and makes contact with the floor of the plug 55. Such contact activates the switch 74 to energize the forwardmost LED 66, which in turn illuminates the forwardmost light pipe 37. As the forwardmost light pipe 37 is illuminated, it directs light through the upper surface 80 of the display cover 32 at the location directly above the light pipe 37. This upwardly-directed light thus illuminates the portion of the indicia 82 directly above the forwardmost light pipe 37, thus indicating a specific heat level for the iron. At the same time, the PCB 39 signals the controller 90 to apply the appropriate level of power to the heating element to provide the selected heat level.

If a different heat level is desired, the user can operate the heat control unit 30 as a toggle mechanism. More specifically, the user simply depresses the front end of the display cover 32 again, which activates the tactile switch 74 again to illuminate the next LED 66 and light pipe 37 and the PCB 39 to signal the controller 90 of the new selected heat level. This process of depressing the front end of the display cover 32 continues, thereby "toggling" through the heat level choices listed by the indicia 82, until the desired heat level is reached.

Those of skill in this art will appreciate that the iron 10 may take different forms. For example, the heat control unit 30 may be illuminated by means other than the LEDS 66 and light pipes 37; as examples, illumination may be provided by LEDS 66 alone, conventional light bulbs, or the like. The display cover 32 may include different indicia, such as numerals, simple illustrations, icons, or the like, to indicate different temperature settings, and may include more or fewer settings (e.g., three settings) than are illustrated herein. Although the display cover 32 is typically transparent or translucent, alternatively it may be opaque, with individual windows therein to enable light to indicate the desired setting.

The mechanism by which the heat control unit 30 operates may also vary. For example, although the heat control unit 30 operates by the display cover 32, the floor 33, and the light frame 34 pivoting about the axis A, more or fewer of these components may be fixed together to form a movable member that is actuated to select between heat settings (e.g., the floor 33 may be omitted). In other embodiments, the pivot axis of the moveable member(s) may be located differently (e.g., toward the front of the movable member rather than at the rear). In further embodiments, the moveable member may not pivot at all, but instead may simply descend and ascend relative to the handle 16. Finally, in some embodiments, the heat control unit may be operated and actuated in a different manner, such that the display cover 32 is located on the handle and simply displays the heat level in a convenient location.

Also, the iron may include additional features that are not described herein, and may lack certain features (e.g., the steam blast buttons 24*a*, 24*b*) that are described herein.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An iron, comprising:
a housing;
a handle attached to an upper portion of the housing;
a sole plate attached to a lower portion of the housing;
a heating element positioned within the housing to heat the sole plate;
a controller operatively connected with the heating element to regulate heat produced by the heating element; and
an illuminated display mounted on one of the housing and the handle and moveable relative to the housing and the handle, the illuminated display operatively connected with the controller, the illuminated display including a transparent display cover such that illumination originating below the illuminated display cover shines through an upper surface of the illuminated display, the illuminated display configured such that manipulation of the illuminated display selects a heat level associated with the sole plate.

2. The iron defined in claim 1, further comprising a steam actuator located below the illuminated display.

3. The iron defined in claim 1, further comprising a spray nozzle mounted on the housing beneath the illuminated display.

4. The iron defined in claim 1, further comprising a steam blast actuator mounted on the handle.

5. The iron defined in claim 1, wherein the illuminated display is mounted on the handle.

6. The iron defined in claim 5, wherein the illuminated display is configured as a toggle mechanism with a moveable member, wherein the toggle mechanism is configured such that actuation of the moveable member sequentially selects different heat levels.

7. An iron, comprising:
a housing;
a handle attached to an upper portion of the housing;
a sole plate attached to a lower portion of the housing;
a heating element positioned within the housing to heat the sole plate;
a controller operatively connected with the heating element to regulate heat produced by the heating element; and
a heat control unit operatively connected with the controller, the heat control unit including an illuminated display, the illuminated display including a transparent display cover such that illumination originating below the display cover shines through an upper surface of the illuminated display, the heat control unit configured as a toggle mechanism with a moveable member, wherein the toggle mechanism is configured such that actuation of the moveable member sequentially selects different heat levels for the sole plate.

8. The iron defined in claim 7, wherein the heat control unit is attached to the handle.

9. The iron defined in claim 8, wherein the moveable member is pivotally mounted relative to the handle at a pivot, such that slight pivotal movement of the moveable member toggles between different heat levels.

10. The iron defined in claim 9, wherein the pivot is located adjacent a rear portion of the movable member.

11. The iron defined in claim 10, wherein the moveable member includes a thumb pad located at a front portion thereof.

12. The iron defined in claim 7, wherein the heat control unit further comprises a tactile switch, the heat control unit configured such that toggling of the moveable member engages the tactile switch, thereby signaling the controller to change the heat level.

13. The iron defined in claim 7, wherein the heat control unit includes a plurality of light sources, and wherein movement of the moveable member causes the selective lighting of one of the light sources to indicate through the display cover a heat level.

14. An iron, comprising:

a housing;

a handle attached to an upper portion of the housing;

a sole plate attached to a lower portion of the housing;

a heating element positioned within the housing to heat the sole plate;

a controller operatively connected with the heating element to regulate heat produced by the heating element; and a heat control unit attached to the handle and operatively connected with the controller, the heat control unit including an illuminated display moveable relative to the handle, the illuminated display operatively connected with the controller, the illuminated display including a transparent display cover such that illumination originating below the display cover shines through an upper surface of the display, the illuminated display configured to indicate a heat level associated with the sole plate, wherein manipulation of the illuminated display selects a heat level for the sole plate.

15. The iron defined in claim 14, wherein the heat control unit is configured as a toggle mechanism with a moveable member, wherein the toggle mechanism is configured such that actuation of the moveable member sequentially selects different heat levels.

16. The iron defined in claim 15, wherein the moveable member is pivotally mounted relative to the handle at a pivot, such that slight pivotal movement of the moveable member toggles between different heat levels.

17. The iron defined in claim 16, wherein the pivot is located adjacent a rear portion of the movable member.

18. The iron defined in claim 17, wherein the moveable member includes a thumb pad located at a front portion thereof.

19. The iron defined in claim 16, wherein the heat control unit further comprises a tactile switch, the heat control unit configured such that toggling of the moveable member engages the tactile switch, thereby signaling the controller to change the heat level.

20. The iron defined in claim 16, wherein the heat control unit includes a plurality of light sources, and wherein movement of the moveable member causes the selective lighting of one of the light sources to indicate through the display cover a heat level.

* * * * *